United States Patent [19]

Luebke

[11] 4,265,398

[45] May 5, 1981

[54] VARIABLE THICKNESS MAT FOR STRESS TRANSITION ZONES OF RAILROAD TRACK CROSSINGS, SWITCHES, AND THE LIKE, AND METHOD OF USE

[75] Inventor: Robert W. Luebke, Hudson, Ohio

[73] Assignee: True Temper Corporation, Cleveland, Ohio

[21] Appl. No.: 92,709

[22] Filed: Nov. 9, 1979

[51] Int. Cl.[3] ..... B32B 5/06; B32B 5/26; E01B 3/44

[52] U.S. Cl. ..... 238/1; 14/73; 238/2; 405/131; 405/258; 428/77; 428/172; 428/189; 428/209; 428/212; 428/215; 428/220; 428/284; 428/287; 428/317; 104/1 R

[58] Field of Search ..... 14/73; 238/1, 2; 405/258; 428/77, 172, 189, 212, 215, 220, 284, 287, 317; 104/1 R

[56] References Cited

U.S. PATENT DOCUMENTS

| | | | |
|---|---|---|---|
| 2,827,412 | 3/1958 | McKay | 428/77 |
| 3,402,227 | 9/1968 | Knee | 264/64 |
| 3,587,964 | 6/1971 | Cork | 238/1 |
| 3,598,680 | 8/1971 | Lee | 19/302 |
| 3,670,506 | 6/1972 | Goudard | 405/258 |
| 3,765,996 | 10/1973 | Munyon | 428/172 |

*Primary Examiner*—James C. Cannon

*Attorney, Agent, or Firm*—Baldwin, Egan, Walling & Fetzer

[57] ABSTRACT

A variable thickness fabric mat for use in railroad track structures, and particularly at stress transition zones in the railroad track; the mat is preferably formed of non-woven, multi-layered fabric, with the layers connected together, as for instance by needle punching to form an integral member. The mats are applicable for use with poor load bearing soils, and form a generally stepped, resilient bed for conventional railroad track structure, to help support and progressively spread the stress from the wheeled traffic, over a wider area. The mats provide for effective passing of runoff water, and aid in drainage of water from the soil beneath the mats, to thus improve the track support. The invention also provides a method of forming a railroad track construction so as to spread the stress from wheeled traffic at stress transition zones, over wider areas.

34 Claims, 8 Drawing Figures

VARIABLE THICKNESS MAT FOR STRESS TRANSITION ZONES OF RAILROAD TRACK CROSSINGS, SWITCHES, AND THE LIKE, AND METHOD OF USE

This invention relates in general to means adapted for underlying a railroad track structure for spreading stress therefrom over wider areas, and more particularly relates to a variable thickness, generally stepped, fabric mat for use especially at stress transition zones of railroad track structure, such as at crossings, switches and the like, for spreading the stress from wheeled traffic over wider areas, while at the same time, being operable to not restrict the passage of water through the mat, and actually aiding in drainage of water from the soil beneath the mat. A method is also disclosed of forming a railroad track structure utilizing the mats of the invention.

BACKGROUND OF THE INVENTION

Non-woven webs of fabric having a variable thickness are known in the art. U.S. Pat. No. 3,402,227 dated Sept. 17, 1968 discloses a process for preparation of such non-woven webs from continuous filaments. Also the use of non-woven fabric on earthen surfaces to spread the stress from road or railway communication routes over a wider area, are likewise known in the art, with such fabric being formed, for instance, of polyester, and having the ability to filter out fine soil particles that would or could otherwise contaminate the track ballast, and also possessing the capability of passing water through the mat so as to actually aid in drainage of water from the soil beneath the mat. U.S. Pat. No. 3,670,506 dated June 20, 1972 and entitled Process For Stabilizing Soils, is directed to a method of utilizing non-woven fabric in poor support areas. Also, the use of mats for protecting bridge decks in a railroad environment are known such as for instance from U.S. Pat. No. 3,587,964 dated June 28, 1971.

Also in U.S. Pat. No. 3,598,680 dated Aug. 10, 1971 there is disclosed an air laying apparatus for making a web or pad of fiberous material with a predetermined non-uniform thickness configuration.

However, to applicant's knowledge, there has never been provided a variable thickness mat for use at stress transition zones in railroad track, and operable to progressively absorb and more evenly spread the stress from wheeled traffic at such zones, over wider areas.

Changes often occur in a railroad track bed's stability and its response to rail loads. These changes are especially detrimental to track stability at stress transition zones such as at track crossing diamonds, switches, car retarders, and the like. Rail and track structure damage may occur when abrupt changes in track structure responses exist as the track structure passes through these high stress zones.

The present mat invention provides an arrangement that changes in mat thickness along its length, and more evenly distributes the loads to the bearing soil as the train vehicle approaches and pass over these high stress regions. Thus as the train or railroad vehicles start their approach into a high stress track region, the fabric mat is relatively thin where the transition stresses are less, and the mat becomes thicker as the track structure stresses increase. Also, with the mat possessing high liquid conducting capabilities, the presence of water is reduced at the bearing ground areas, which further aids in the stability of the track structure, and the reduction of stresses applied thereto.

SUMMARY OF THE INVENTION

The present invention provides a novel variable thickness mat particularly adapted for use in stress transition zones of railroad track structure, so as to reduce abrupt changes in track structure response to wheeled traffic passing over the track at the high stress zones, as well as a novel method of reducing the stress applied to the track structure at stress transition zones, such as at crossings and switches, by utilization of a stepped variable thickness mat beneath the track structure.

Accordingly, an object of the invention is to provide a novel variable thickness mat for use particularly at stress transition zones at railroad track structures.

Another object of the invention is to provide a mat of the aforementioned type which is formed of non-woven fabric.

A still further object of the invention is to provide a mat of the above described type which is comprised of at least three layers of fabric material, with the layers being stepped to provide a variable thickness, stepped configuration of mat, and wherein the layers are connected together, such as by needle punching of the layers, into an integral mat structure.

Another object of the invention is to provide a mat of the aforementioned type wherein each of the steps of the mat are of predetermined length so as to generally progressively absorb increasing stresses to the track structure upon movement of the wheeled vehicle traffic over the track, to the underlying ground support, with such lengths being at least as long as the conventional or usual length of a railroad car.

A still further object of the invention is to provide a mat of the aforementioned type which is capable of passing water therethrough, to thereby aid in eliminating water from the bearing surface of the ground support and provide for increased stability of the ground bearing surface.

A still further object of the invention is to provide a railroad track structure utilizing a stress transition zone mat of the aforediscussed type.

A still further object of the invention is to provide a novel method of reducing the stresses at stress transition zones in a railroad track structure.

Other objects and advantages of the invention will be apparent from the following description taken in conjunction with the accompanying drawings, wherein,

DESCRIPTION OF PREFERRED EMBODIMENTS

Figure 1:
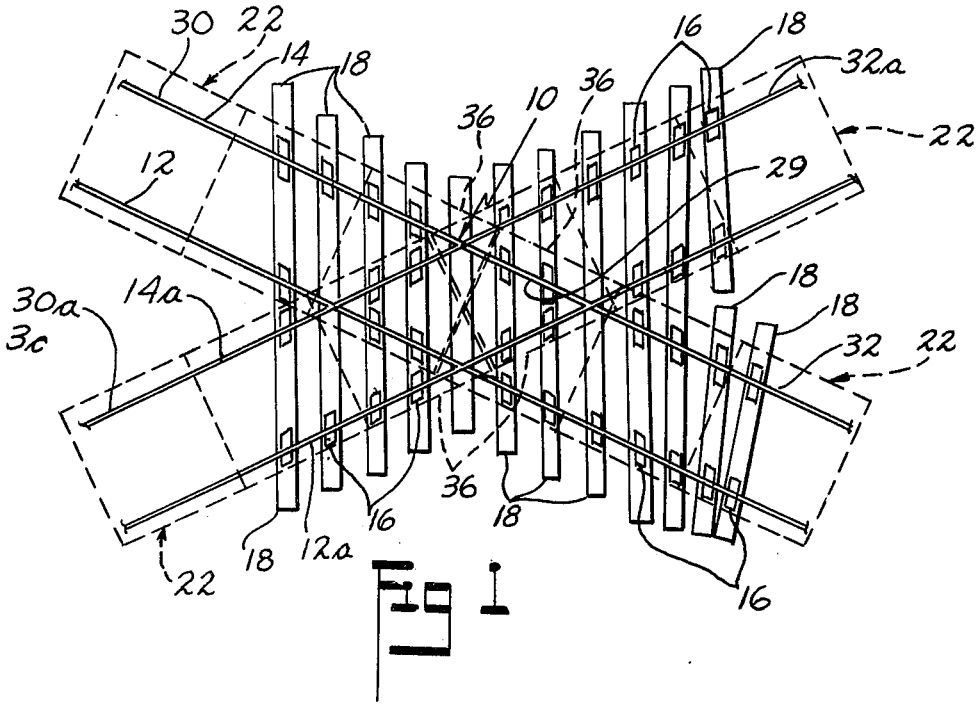
FIG. 1 is a generally diagrammatic plan view of a railroad track crossing, and showing in dash lines the location of the variable thickness mat arrangement of the present invention.

Referring now again to the drawings, there is illustrated in FIG. 1 a railroad track crossing comprising, in particular, a diamond crossing 10 including the conventional pairs of rails 12, 14 and 12*a*, 14*a* which may be supported on the usual tie plates 16 which in turn are supported on and secured to the underlying ties 18. The ties 18 are supported, and embedded in the conventional manner, in a bed of conventional ballast 20 (such as rock and stone) which normally provides the support for the track structure on the rail bearing surface 21 of the underlying ground area.

Changes often continuously occur in a railroad track bed's stability and its response to rail loads. These changes are especially detrimental to track stability where the railway right of way passes through what is called stress transition zones such as at railway track crossings, switches, car retarder locations, and the like. Rail track structure damage may occur due to abrupt changes in track structure response, where such track structure passes through these higher stress zones. Moreover, the situation is aggravated when the soil bearing surface for the trackway is poor, such as in the presence of high water content, or poor supporting soils such as loose soils, which do not provide a good support base for the comparatively heavy stresses to which railroad track are subjected during the movement of train traffic thereover.

In order to alleviate the uneven application of stress forces to the underlying railroad track structure and thus to the underlying soil support during the passage of railroad vehicles over the track, there is provided in accordance with the invention a variable thickness mat 22, which is adapted to be located beneath the stress transition zones of the railroad track structure, and which comprises a plurality of layers (FIGS. 2 and 3) 22*a*, 22*b* and 22*c*, of non-woven, fiberous fabric material, which are held or connected together by suitable means (and preferably by needle punching of the layers) so as to provide an integral mat member. Non-woven fabrics for use in the construction and railroad industries are well known, with such fabrics being utilized in the construction industry for the laying of the automotive roadways as well as in railroad track routes. These known fabrics which are made from a plurality of materials such as for instance from polyesters, are available from a plurality of companies, including the assignee of the instant invention.

The layers 22*a*, 22*b* and 22*c* of the mat 22 may be fastened or connected together, utilizing a needle loom, thus mechanically connecting all of the webs of layers thereof together into an integral member. Needle looms presently available can handle widths of the non-woven fabric of from between 65 to 160 inches, and generally operate in the range of between 600 to 850 punches per minute. Such type of needle looms are manufactured by a plurality of companies.

Figure 3:
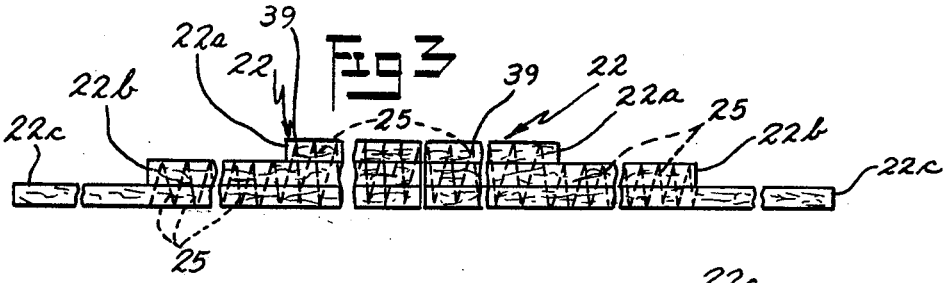
FIG. 3 is a generally diagrammatic, partially broken elevational view, illustrating a variable thickness, stepped mat utilized in the railroad track crossing arrangement of FIG. 1.

The stepped layers of fabric are advanced into the loom, and the needle board of the machine descends, driving the conventional barbed needles a controlled distance through the layered fabric. The needle barbs on their downward passage engage the fibers pushing them through the layered-structure and interlocking them into individual groups. As the needle board starts upward, the punched fiber groups slide clear of the needle barbs without tangling the interlocked fiber bonds. The end result is a flexible layered mat of high stability with the layers thereof secured together by the punched fiber groups as at 25 (FIG. 3).

If so desired, the needles may be heated to a predetermined temperature so as to also fuse the fibers with which they make contact, and thus further strengthen the connection of the layers together.

Chemical binders of suitable known type may also be utilized between the layers of the mat, for aiding in connecting the layers together. For most purposes, however, and for the purposes of underlying railroad track crossing, switches, and car retarder installations, with which the present product is particularly applicable, needle connecting or bonding is adequate, and chemical binders are not necessary.

The mats are expeditiously useable with poor load bearing soils, and form an effective resilient support bed for railroad tracks in such an environment, to help support and spread the concentrated stress from wheeled traffic, over a wider area, as well as actually siphoning ground water and filtering out fine soil particles that could otherwise contaminate track ballast. The mats readily pass runoff water and facilitate drainage of water from the soil beneath the mats, thus aiding in stabilizing the bearing soil base.

The non-woven fabrics are resistant to attacks by the components normally found in soils and in ground water, and aid in maintaining the ballast layer 20 free of fluids as well as maintaining it to be well drained. The layers of the mats may be formed of a polyester which is a stable, long-lived polymer, and preferably is of such porosity that the mat will hold back particles larger than 70 microns, while generally permitting smaller water born fines to pass through without clogging or binding the fabric.

Referring now in particular to FIGS. 1 through 4, the first or bottommost of the layers 22*c* of the stepped mat may be of approximately 100 mil thickness, while the second and third layers may be of approximately 110 mil thickness, with the means 25 connecting the layers together comprising the aforementioned interlocked fibers from the various layers, and as produced by the needle punching of the mats and as aforedescribed.

Each of the steps defined by the overlapping layers of fabric, is preferably of at least 100 foot length, which length is generally at least as great as and preferably greater than, the length of a conventional railroad car, so that the stresses being applied to the railroad track structure as a train approaches or passes over and leaves the crossing or switch will be progressively and smoothly applied to the underlying mat and thence to the base soil support. It will be seen therefore that in effect the mat tapers along its length, and generally evenly distributes the load as the train approaches these high stress regions of the track structure, passes over the crossing or switch, and then departs from the latter. Thus it will be seen that the fabric is thinner where the transition stresses are less and becomes thicker as the track structure stresses increase, with the maximum thickness of mat being disposed beneath the diamond portion of the crossing where the stresses applied to the track structure by a train are the greatest.

In selecting the proper fiber for use in the non-woven fabrics, the fiber specifications and more specifically the crimp, the length, and the denier per element, are relatively important. The fibers depending on the type, may have varying amounts of natural crimp (or curl) just as a cut filament may be mechanically or articially crimped prior to use. However, naturally curly fibers are generally better than straight fibers, for accomplishing the holding or connecting of the mat layers together into an integral member.

The choice of the denier per filament or fiber used in the non-woven fabric is governed primarily by the requirements of the end product. The use of a finer fiber results in greater density strength and softness. However, a denier in the range of 5–10 is preferred for use in the mats' of the invention.

Figure 2:
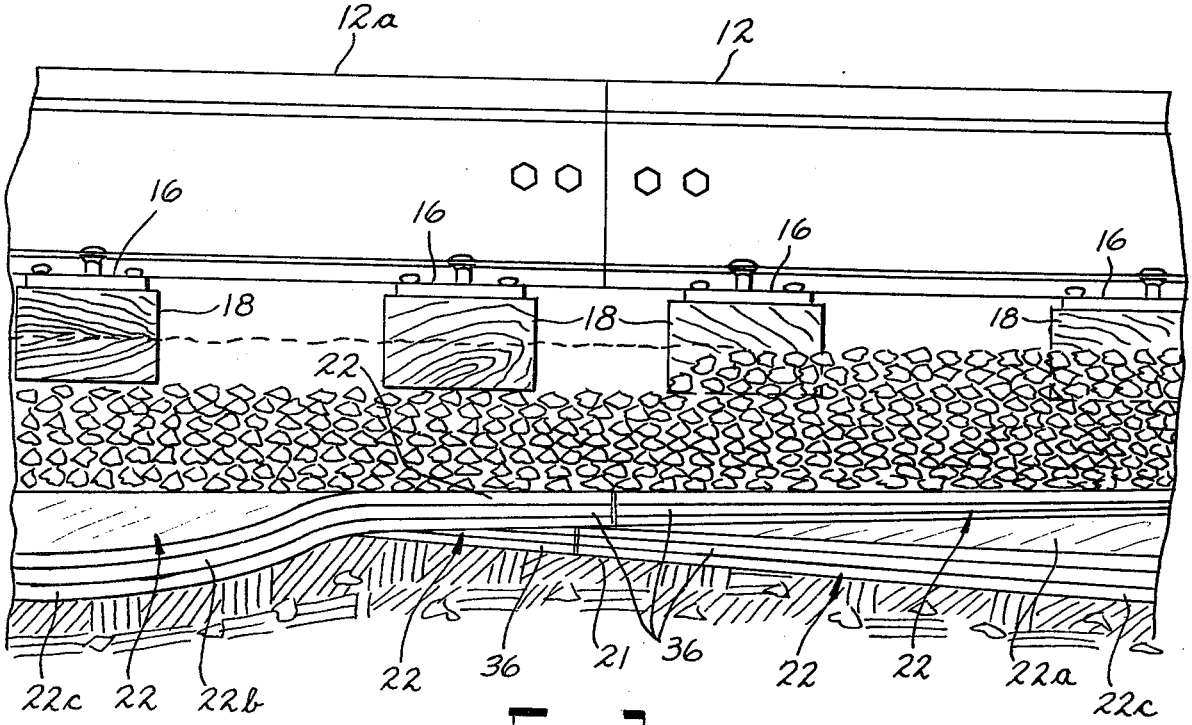
FIG. 2 is an enlarged partially sectioned, side elevational view illustrating the utilization of the mat structure in the railroad track, stress transition zone illustrated in FIG. 1.
Figure 4:
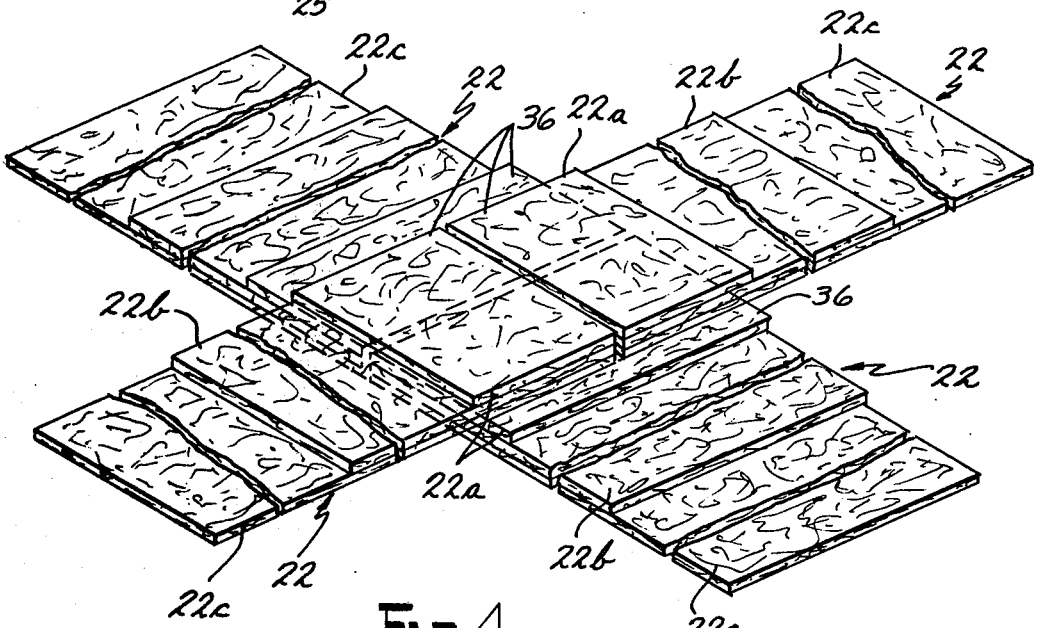
FIG. 4 is an enlarged, generally perspective illustration of the mat assembly per se utilized at the railroad crossing of FIG. 1.

As can be best seen in FIG. 4, the mat assembly for a general FIG. 2 type crossing is preferably comprised of a plurality of mats, pairs of which are disposed in generally juxtaposed head-to-head relation, with respect to one another, and extending laterally away from the diamond portion 29 of the track structure crossing, and sufficiently so as to be disposed beneath the crossing entry and crossing exit track portions 30, 32 and 30*a*, 32*a* of the 12, 14 and 12*a*, 14*a* track structures. As shown, pairs of vertically oriented mats are utilized at the crossing, with the thickest portions 36 thereof oriented in vertically juxtaposed condition and with the thinner portions of each mat extending outwardly away from the thickest portion and in general alignment with the respective track portion 30, 32 or 30*a*, 32*a* of the crossing.

Referring now to FIG. 3, the mat may have a layer of abrasion resistant material 39 on the top surface thereof. Such layer may be formed for instance of rubber or plastic, or any other suitable material so as to provide an arrangement which resists wear and puncture by the overlying ballast bed. Such abrasion resistant layer is preferably applied to the mat after the connecting of the layers thereof together (e.g. 25) and may be applied as by spraying, or by the use of suitable known adhesives, to attach layer 39 to the underlying surface of the mat.

The following is a table which lists various typical physical characteristics of one of the polyester fabrics utilized in the production of the mats.

| Property | Value | Test Method |
|---|---|---|
| composition | 100% polyester | |
| construction | fiber needle punch bonding | |
| Tensile, lbs. | 240+ | ASTM D-1682 |
| Mullen Burst, lbs. | 200+ | Mullen Test |
| Width, inches | 150 | — |
| Thickness, mils | 100 | ASTM D-1777 |
| Grab Elongation % Ultimate | 95–105 | ASTM D-1682 |
| Puncture Resistance, lbs. | 125 | |
| Abrasion Resistance 1000 gm weight - 1000 cycles CS17 wheel | 50% | Tabor Test |

-continued

| Property | Value | Test Method |
|---|---|---|
| Air Permeabilty cfm | 70–160 | ASTM D-737 |

Figure 5:
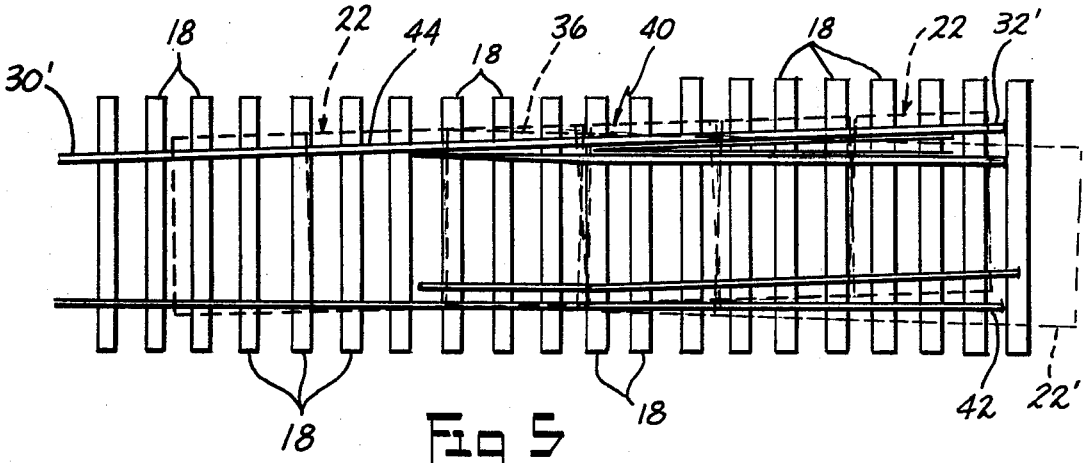
FIG. 5 is a top plan, generally diagrammatic illustration of a switch in a railroad track structure, and illustrating in dotted lines a stress absorbing mat assembly therewith.
Figure 6:
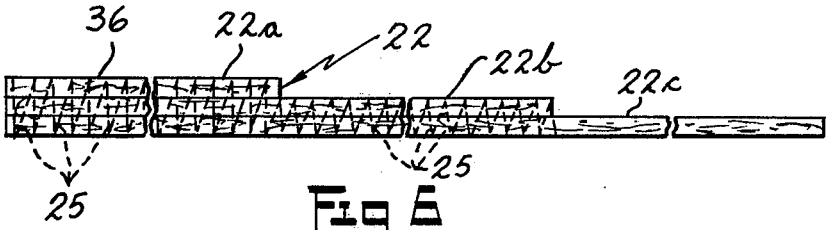
FIG. 6 is a generally diagrammatic, partially broken side elevational view of a stepped variable thickness mat utilizable in the switch arrangement of FIG. 5.
Figure 7:
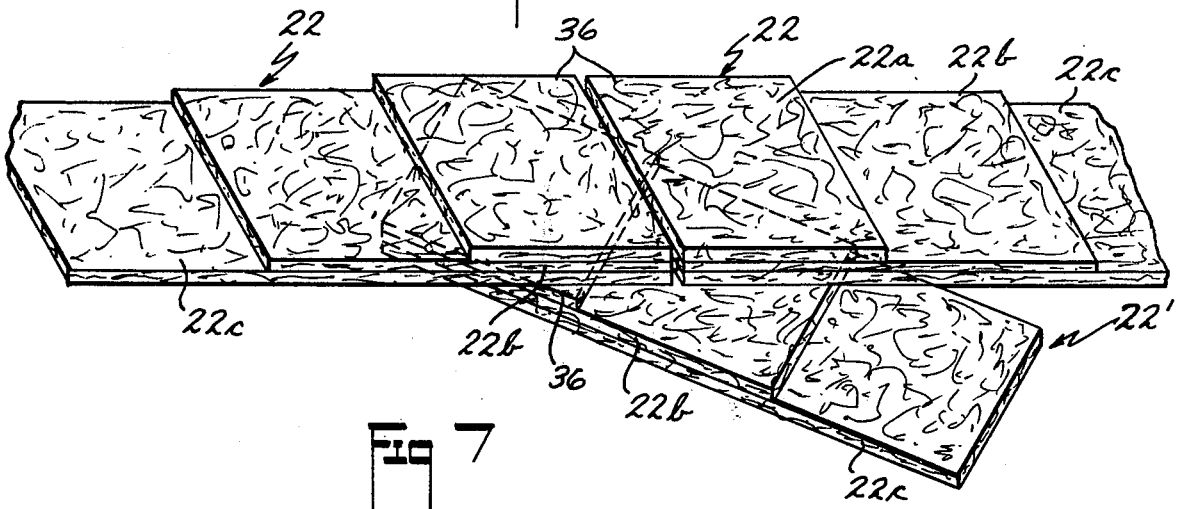
FIG. 7 is an enlarged, generally diagrammatic perspective view of the mat structure assembly per se, for use in the railroad track switch arrangement of FIG. 5.

Referring now to FIG. 5, there is shown another type of stress transition zone of a railroad track structure, and more particularly a switch 40 in which a portion 42 of the railroad track is switched off from the main line portion 44 thereof. Such switch transition zone is adapted, in accordance with the invention, to utilize underlying mats 22 of the same general construction as that aforedescribed in connection with FIGS. 1 through 4.

The thicker portion 36 of the mat is disposed beneath the switch 40, with the thinner portions of the mat extending laterally away from the thicker portion and in underlying relation to the entry and exit portions 30', 32' of the main line track structure. As can be best seen from FIG. 4, a pair of head-to-head, generally abutting mats are utilized, with the thinner portions of the mats underlying the approach section 30' and the exit portion 32' of the main track, with the thickest portions of the juxtaposed mats being disposed immediately under the switch zone, and then the mats progressively diminish in thickness from said switch zone, of the main line. The switch mat 22' coacts in vertically oriented assembled relationship with the main line mats, and with the thickest portion 36' thereof being disposed beneath the switch zone of the track structure, and then the mat thins out in its lengthwise direction, along the exit section of the switch line 42. Thus the stresses are progressively and generally uniformly, applied to the underlying soil bearing areas as received from the track structure via the mats, thus maintaining the integrity of the track structure.

Any run off water or moisture disposed in the soil bearing areas 21 is permitted to pass through the mats due to their porosity, and any moisture in the underlying soil is actually siphoned out through the pores of the mats, while the mud or dirt is generally prevented from passing through the mats, thus aiding in stabilizing the underlying soil bearing areas.

Figure 8:
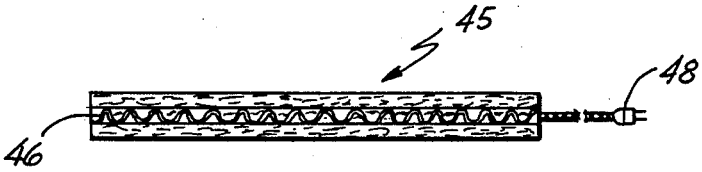
FIG. 8 is another embodiment of mat structure for use in the stress transition zones of FIGS. 1 and/or 5 and illustrating a mat which includes an electrical heating element associated therewith, for applying heat to the transition zone, to aid in the reduction of temperature induced stresses thereat.

Referring now to FIG. 8, there is shown a further embodiment of mat structure 45 which is shown as a transverse cross sectional illustration of one step of a mat, and in which an electrical heating element 46 or elements, has been incorporated into the mat structure, for applying heat to the associated track transition zone, thereby aiding in alleviating stresses due to temperature, at a particular zone of the track structure. Such heating elements may be provided with a conventional coupling 48 for plugging into a source of electrical energy, thus applying heat to the heating element 46, which through conduction and radiation, causes the heat to be transmitted to the adjacent railroad track components, and underlying soil bearing areas.

From the foregoing description and accompanying drawings it will be seen that the invention provides a novel variable thickness mat for use at stress transition zones of railroad track structure, such as for instance at crossings, switches, car retarder areas, and the like, and especially a mat of non-woven fabric material formed of a plurality of layers of the fabric, fastened together, as for instance by needle punching, into an integral member, with the mats being operable to better distribute the stress loads of a train to the track structure at high stress zones, and thence to the soil bearing areas, as the train approaches, passes over, and exits from such high stress zones. The invention also provides a mat that compensates for poor bearing soil conditions for the track structure, such as for instance where there exists the undue presence of water, or at other poor soil conditions, and a mat that possesses high liquid conducting capabilities, high puncture resistance as well as abrasion resistance.

The invention also provides a method of spreading the stresses at transition zones of railroad track structure, to the underlying bearing soil areas, and in a manner utilizing the mats of the invention.

The terms and expressions which have been used, are used as terms of description and not of limitation, and there is no intention in the use of such terms and expressions, of excluding any equivalents, of any of the features shown or described, or portions thereof, and it is recognized that various modifications are possible within the scope of the invention claimed.

What is claimed is:

1. A method of providing for the spreading of stress from wheeled traffic on a railroad track structure including a track crossing, switch or the like, over an increased area, comprising the steps of placing a variable thickness, stepped fabric mat on an earthen support surface along the stress transition zones of the track crossing, switch or the like, placing a layer of ballast on said mat and placing the track structure including the ties and the rails on the ballast, with said mat extending sufficiently lengthwise along the track structure so as to progressively transmit the stress due to wheeled traffic on the tracks to the underlying earth bearing surface via said mat from the minimum stress zone to the maximum stress zone and vice versa.

2. A method in accordance with claim 1 wherein the mat is formed of at least three layers of non-woven fiberous fabric material, with the first layer being approximately 100 mils in thickness, the second layer being approximately 110 mil thickness, and the third layer being of approximately 110 mil thickness, with said third layer being the top layer.

3. A method in accordance with claim 1 including the step of applying the mat to the ground support surface in a manner so that the maximum stress transition zone is underlaid by the thickest portion of the mat.

4. A method in accordance with claim 1 including the step of preparing the underlying bearing soil surface by leveling it prior to application of the mat to the bearing area.

5. A method in accordance with claim 1 including applying an abrasion resistant coating to the top surface of the stepped mat, in the interests of resisting puncturing of the mat by the ballast.

6. A method in accordance with claim 3 including the step of applying a second mat to the area of the maximum stress zone of the track structure, and in vertically overlapping relation to the first mentioned mat.

7. A variable thickness stepped mat of non-woven fabric material adapted for use at stress transition zones of railroad track, such as at crossings and switches thereof.

8. A mat adapted for location beneath stress transition zones of railroad track structure, said mat being stepped and comprising, layers of fabric material connected together into an integral member.

9. A mat in accordance with claim 8 wherein the mat is formed of at least three layers of non-woven fibrous fabric material, said layers being of different lengths and being disposed in superimposed relation to form said stepped configuration, the first layer being of approximately 100 mil thickness, the second layer being approximately 110 mil thickness, and the third layer being of approximately 110 mil thickness, and with the means connecting the layers together comprising interlocked fibers from the various layers produced by needle punching of the mat.

10. A mat in accordance with claim 9 wherein the non-woven fabric is formed of polyester fiber.

11. A mat in accordance with claim 7 wherein the non-woven fabric is formed of polyester fiber.

12. A mat in accordance with claim 7 wherein the fibers of the non-woven fabric are between approximately 5–10 denier.

13. A mat in accordance with claim 7 wherein the fibers of the fabric are crimped.

14. A mat in accordance with claim 7 wherein the mat is multi-layered and is needle punched, thereby providing means connecting the layers of the mat together.

15. A mat in accordance with claim 9 wherein the fibers of the non-woven mat are between approximately 5–10 denier.

16. A mat in accordance with claim 7 wherein the uppermost surface of the mat includes a layer of abrasion resistant material.

17. A mat in accordance with claim 7 wherein the tensile strength of the fiber of the mat is at least 240 pounds.

18. A mat in accordance with claim 7 wherein the fiber has a Mullen burst strength of at least 200 pounds.

19. A mat in accordance with claim 7 wherein each layer of the mat has a puncture resistance of approximately 125 pounds.

20. A mat in accordance with claim 7 which has an air permeability of between approximately 70 to 160 cubic feet per minute as defined by ASTM D-737.

21. A mat in accordance with Claim 7 which has a grab elongation of approximately 95% ultimate to approximately 105% ultimate.

22. A rectangular shape, in plan, fabric mat, adapted for use at stress transition zones of a railroad track, such as for instance, at crossings, switches, or the like and having a stepped configuration in elevation, in a direction lengthwise of the mat, and with the side surfaces of the mat being generally vertically oriented, said mat varying from a thickness of approximately 100 mils to a thickness at least approximately three times the first mentioned thickness.

23. In combination with a railroad track crossing, a resilient mat disposed beneath said crossing and extending therefrom along the tracks for a predetermined distance to provide a resilient base, for the stress transition zones of the track to thereby progressively absorb the stress forces from a train passing over said crossing, a layer of ballast disposed on top of said mat and supporting thereon the ties of the railroad track, said mat comprising a multi-layer fabric member of stepped configuration, with the thicknest portion thereof being disposed immediately beneath the crossing and with the thinner portions thereof extending outwardly away from said thickest portion and in general alignment with the respective entry and/or exit track portions of the crossing.

24. The combination in accordance with claim 23 wherein the bottommost of said layers of said mat is of approximately 100 mil thickness and the other of said layers are each of a thickness at least as great as the first mentioned thickness, said mat being of predetermined length and with each of said layers being of a different length as compared to the length of the adjacent layers, said mat being formed of non-woven fabric.

25. The combination in accordance with claim 24 wherein the fibers of the non-woven fabric are between approximately 5 to 10 denier.

26. The combination in accordance with claim 23 wherein the mat comprises three layers, the bottommost layer being approximately 300 feet in length, the intermediate layer being approximately 200 feet in length, and the uppermost layer being approximately 100 feet in length, one end of all said layers being disposed in substantially the same vertical plane and with the other end edges thereof forming the stepped configuration of the mat.

27. The combination in accordance with claim 23 wherein there is disposed beneath said crossing a pair of said mats with, the thickest portions thereof oriented in generally vertically juxtaposed condition so that the thinner portions of each of said mats extend outwardly away from the thickest portion thereof and in general alignment with respective track portion of the crossing.

28. The combination in accordance with claim 23 including means connecting the layers of fabric together into an integral member.

29. The combination in accordance with claim 28 wherein the said connecting means comprises interlocked fibers from the various layers of the mat, said interlocking being produced by needle punching of the mat.

30. The combination in accordance with claim 29 wherein the fibers of the fabric are crimped to thereby facilitate the interlocking of the fibers together during the needle punching thereof.

31. The combination in accordance with claim 23 wherein the upper surface of said mat includes a layer of abrasion resistant material on which said layer of ballast rests.

32. The combination in accordance with claim 23 wherein a pair of said mats are disposed beneath said crossing in stacked relationship with one another but being generally aligned with and extending along the respective track portion of the crossing.

33. In combination with a railroad track switch, a resilient mat disposed beneath said switch and extending therefrom along the main track line for a predetermined distance, to provide a resilient base for the stress transition zones of the main track line to thereby progressively absorb the stress forces from a train passing over said switch, a layer of ballast disposed on top of said mat and supporting thereon the ties and rails of the railroad tracks, said mat comprising a multi-layer fabric member of stepped configuration in elevation with the thickest portion thereof being disposed immediately beneath the switch and with the thinner portions thereof extending outwardly away from said thickest portion and in general alignment with the respective main track section of the switch.

34. The combination in accordance with claim 33 including a further multi-layer fabric mat of stepped configuration in elevation coacting with the first mentioned mat, and with the thickest portion of said further mat being disposed in generally vertical juxtaposed relation with the thickest portion of the first mentioned mat, and with the thinner portions of the further mat extending outwardly away from the thickest portion thereof in general alignment with the respective switch track section.

* * * * *